US008844210B2

(12) United States Patent
Henriott

(10) Patent No.: US 8,844,210 B2
(45) Date of Patent: Sep. 30, 2014

(54) UPMOUNT OVERHEAD BRACKETS FOR OFFICE PARTITION SYSTEMS

(75) Inventor: Jay M. Henriott, Jasper, IN (US)

(73) Assignee: Kimball International, Inc., Jasper, IN (US)

( * ) Notice: Subject to any disclaimer, the term of this patent is extended or adjusted under 35 U.S.C. 154(b) by 44 days.

(21) Appl. No.: 13/327,892

(22) Filed: Dec. 16, 2011

(65) Prior Publication Data

US 2012/0167500 A1 Jul. 5, 2012

Related U.S. Application Data

(60) Provisional application No. 61/429,607, filed on Jan. 4, 2011.

(51) Int. Cl.
*E04B 2/74* (2006.01)
*A47B 96/06* (2006.01)

(52) U.S. Cl.
CPC ..... *E04B 2/7433* (2013.01); *E04B 2002/7418* (2013.01); *A47B 96/06* (2013.01)
USPC ..... 52/36.5; 52/239; 52/241; 312/246; 248/220.21; 248/228.6; 248/231.71

(58) Field of Classification Search
USPC ..... 52/36.1, 36.5, 238.1, 239, 241, 242; 312/140.4, 194, 245–246; 248/200, 248/220.21, 220.22, 226.11, 228.6, 231.71
See application file for complete search history.

(56) References Cited

U.S. PATENT DOCUMENTS

| | | | | | |
|---|---|---|---|---|---|
| 4,008,872 | A | * | 2/1977 | Thompson | 248/224.61 |
| 4,224,769 | A | * | 9/1980 | Ball et al. | 52/36.1 |
| 4,559,738 | A | * | 12/1985 | Helfman | 47/67 |
| 4,640,045 | A | | 2/1987 | Nesbitt et al. | |
| 4,642,926 | A | | 2/1987 | Friedman | |
| 4,698,936 | A | * | 10/1987 | Helfman | 47/68 |
| 4,914,873 | A | * | 4/1990 | Newhouse | 52/36.1 |
| 4,932,177 | A | * | 6/1990 | Hinden | 52/220.7 |
| D312,014 | S | * | 11/1990 | Friedman | D6/509 |
| 4,986,505 | A | * | 1/1991 | Zabawski et al. | 248/214 |
| 5,103,741 | A | * | 4/1992 | Grund et al. | 108/101 |
| 5,240,214 | A | * | 8/1993 | Birnbaum et al. | 248/231.41 |
| 5,274,970 | A | * | 1/1994 | Roberts | 52/126.2 |
| 5,309,686 | A | * | 5/1994 | Underwood et al. | 52/29 |
| 5,368,266 | A | | 11/1994 | Allen | |
| 5,826,385 | A | * | 10/1998 | Dykstra et al. | 52/220.7 |
| 5,836,112 | A | * | 11/1998 | Lindale et al. | 52/36.4 |
| 5,887,384 | A | | 3/1999 | Zaremba | |

(Continued)

OTHER PUBLICATIONS

Knoll, "Dividends Horizon", Product Information, at least as early as Dec. 16, 2011.

(Continued)

*Primary Examiner* — Adriana Figuerao
(74) *Attorney, Agent, or Firm* — Faegre Baker Daniels LLP

(57) ABSTRACT

Brackets for an office partition system permit the off-modular attachment of articles of furniture, such as cabinets, above the upper edges of panels in the partition system. The width of the furniture article may be either equal to, less than, or greater than the width of an underlying panel. Also, the location of the furniture article may be adjusted relative to the underlying panels such that the location of the furniture article is not determined by the size or position of an underlying panel to which the furniture article is attached.

7 Claims, 12 Drawing Sheets

(56) References Cited

U.S. PATENT DOCUMENTS

| | | | | |
|---|---|---|---|---|
| 5,984,249 | A | 11/1999 | Cohen | |
| 6,012,690 | A * | 1/2000 | Cohen | 248/226.11 |
| 6,076,308 | A * | 6/2000 | Lyon et al. | 52/36.6 |
| 6,076,903 | A * | 6/2000 | Vander Park | 312/196 |
| 6,108,971 | A | 8/2000 | Zaremba | |
| 6,115,977 | A * | 9/2000 | Hornberger et al. | 52/238.1 |
| 6,152,048 | A * | 11/2000 | Vander Park | 108/50.02 |
| 6,286,275 | B1 | 9/2001 | Edwards | |
| 6,378,255 | B1 * | 4/2002 | Eich et al. | 52/220.7 |
| D459,924 | S * | 7/2002 | Heidmann et al. | D6/510 |
| 6,536,858 | B1 * | 3/2003 | Heidmann et al. | 312/245 |
| 6,748,710 | B2 | 6/2004 | Gresham et al. | |
| 6,807,776 | B2 * | 10/2004 | Girdwood et al. | 52/36.1 |
| 7,096,519 | B2 | 8/2006 | Ferreri et al. | |
| 7,310,918 | B1 * | 12/2007 | Reuter et al. | 52/220.7 |
| 8,051,506 | B2 * | 11/2011 | Segal | 4/597 |
| 8,104,850 | B2 * | 1/2012 | Hager et al. | 312/245 |
| 2002/0112411 | A1 * | 8/2002 | Gravel et al. | 52/36.1 |
| 2003/0196392 | A1 * | 10/2003 | Edwards | 52/220.1 |
| 2006/0162268 | A1 * | 7/2006 | Eberlein et al. | 52/236.9 |
| 2007/0251428 | A1 | 11/2007 | Mead et al. | |
| 2007/0294953 | A1 * | 12/2007 | Guillen | 52/36.1 |
| 2009/0293402 | A1 * | 12/2009 | Hamilton et al. | 52/481.2 |
| 2010/0064597 | A1 * | 3/2010 | Eberlein et al. | 52/36.5 |
| 2011/0169386 | A1 * | 7/2011 | Hardy et al. | 312/246 |

OTHER PUBLICATIONS

Steelcase, "Answer", Product Information, Nov. 2011.
Teknion, Product Information, Feb. 28, 2011 and Sep. 26, 2011.
Allsteel, "Stride", Product Information, Aug. 2010 and May 2011.
Haworth, Product Information, May 2011.
Herman Miller, "Canvas", Product Information, Sep. 2011.

* cited by examiner

UPMOUNT OVERHEAD BRACKETS FOR OFFICE PARTITION SYSTEMS

CROSS REFERENCE TO RELATED APPLICATIONS

This application claims the benefit under Title 35, U.S.C. §119(e) of U.S. Provisional Patent Application Ser. No. 61/429,607, entitled UPMOUNT OVERHEAD BRACKETS FOR OFFICE PARTITION SYSTEMS, filed on Jan. 4, 2011, the entire disclosure of which is expressly incorporated by reference herein.

BACKGROUND

1. Field of the Invention

The present invention relates to office partition systems, and in particular to brackets which allow for the off-modular overhead mounting of articles of furniture, such as cabinets, to panels of an office partition system.

2. Description of the Related Art

Office partition systems generally include a plurality of connected panels to which modular articles of furniture, such as cabinets, may be mounted. Typically, each cabinet has a width that is equivalent to the width of the panel to which it is attached.

For example, it is known to mount cabinets to the vertical face of a panel framework by attaching cabinets to tracks disposed along the sides of one or more panels in the panel framework. Alternatively, a cabinet may be attached to the vertical face of a panel framework via hook elements of the cabinet attaching to one of a plurality of vertical slots disposed along vertical end posts eat each end of a panel frame section.

An improvement over the foregoing is desired.

SUMMARY

The present disclosure provides brackets for an office partition system that permit the off-modular attachment of articles of furniture, such as cabinets, above the upper edges of panels in the partition system. In this manner, the width of the furniture article may be either equal to, less than, or greater than the width of an underlying panel. Also, the location of the furniture article may be adjusted relative to the underlying panels such that the location of the furniture article is not determined by the size or position of an underlying panel to which the furniture article is attached. In a first embodiment, the bracket includes a horizontal member and a vertical post, the vertical post received within a vertical end post of a panel. A cabinet is mounted in an adjustable manner relative to the horizontal members of a spaced pair of the brackets. In a second embodiment, the bracket includes a horizontal member attached to a pair of vertical flanges, which in turn attach to respective horizontal tracks positioned on opposite sides of one or more panels proximate the top edge of the panels. A cabinet is mounted in an adjustable manner to the horizontal members of a pair of spaced brackets, and the locations of the vertical flanges of each bracket, and thereby the location of the cabinet, is infinitely adjustable along the channels.

In one form thereof, the present disclosure provides an office partition system, including a framework having an upper edge and including at least one vertical frame member; a bracket received within the vertical frame member; and an accessory component adjustably mounted to the bracket and disposed above the upper edge of the framework.

In another form thereof, the present disclosure provides an office partition system, including a framework having an upper edge and including a pair of track members disposed on respective opposite sides of the framework, the track members disposed proximate the upper edge; a bracket respectively adjustably mounted to each of the track members; and an accessory component mounted to the bracket and disposed above the upper edge of the framework.

In another form thereof, the present disclosure provides a cabinet assembly, includes a cabinet having front, rear, left side, right side, and bottom walls, and a frame structure disposed adjacent the bottom wall, the frame structure at least in part defining a pair of opposed clearances between the frame structure and the bottom wall, the clearances extending parallel to one another; and at least one bracket having opposite ends extending between and respectively received within the clearances, the bracket slidable along the clearances whereby a position of the cabinet is adjustable relative to the at least one bracket.

BRIEF DESCRIPTION OF THE DRAWINGS

The above-mentioned and other features and advantages of this disclosure, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the disclosure in any manner.

DETAILED DESCRIPTION

Figure 1:
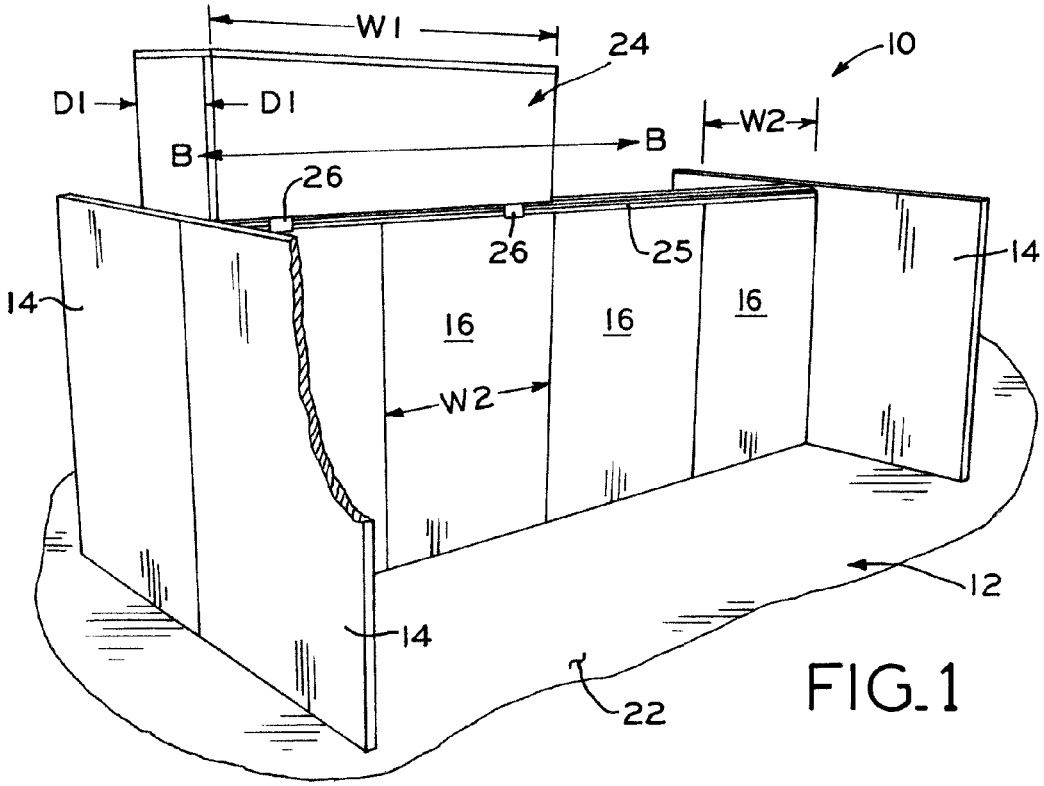
FIG. 1 is a perspective view of an office partition system with an overhead cabinet that is mounted with brackets according to the present invention.

The present disclosure provides brackets which permit the off-modular attachment of accessory components of articles of furniture, such as cabinets, above the upper edges of panels of a partition system. Referring to FIG. 1, an office partition system 10 may include panels 14 and 16 that define separate office spaces for use by office personnel, for example. As shown in FIG. 1, office partition system 10 includes office space 12, which may be one of multiple office spaces defined by office partition system 10. Office space 12 of partition system 10 includes end panels 14 and intermediate panels 16 that are supported on floor 22.

As further described below, an article of furniture or accessory component, such as cabinet 24, for example, is mounted above one or more of the panels 14 and 16 in an off-modular manner via brackets according to the present disclosure.

Generally, in known "modular" partition arrangements in which accessory furniture components are mounted to partition system panels, the accessory component has substantially the same width as a panel to which the accessory component is mounted, with the accessory component disposed in a vertically aligned or centralized position with respect to the panel.

According to the "off-modular" mounting of accessory components provided by the brackets disclosed herein, accessory components may have a width that differs from the width of an underlying panel to which the component is attached, i.e., the width of the component is not tied to, or determined by, the width of the underlying panel such that the width of the component may be less than or greater than the width of the panel to which the component is mounted. In some embodiments, the location of the accessory component is also not tied to, or determined by, the location or width of an underlying panel, such that the location of the accessory component may be adjustable with respect to position or location of the underlying panel to which the component is mounted.

For example, as shown in FIG. 1, an accessory component such as cabinet 24 is attached to panels 16 in an off-modular fashion in which the location of cabinet 24 is horizontally adjustable with respect to panels 16 along the direction of line B-B. Also, cabinet 24 has width W1 that is greater than width W2 of an underlying panel 16. As shown herein, cabinet 24 may be disposed in its entirety above the upper edge of the framework of partition system 10, and may have a depth dimension D1 in FIG. 1 greater than the width or thickness of the underlying panels 16 of the framework, such that cabinet 24 straddles the framework of partition system 10.

Exemplary Cabinet Structure

Figure 2:
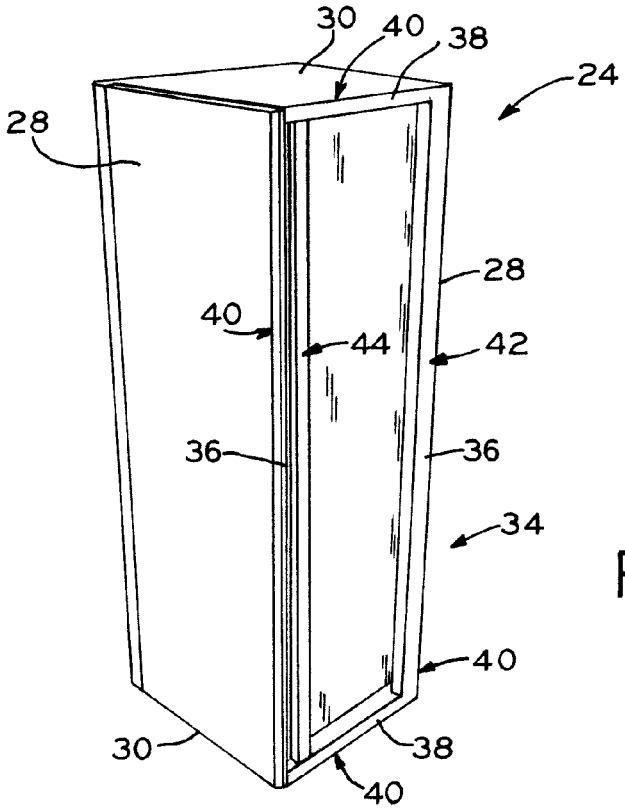
FIG. 2 is a perspective view of the bottom portion of the cabinet of FIG. 1.

Referring to FIG. 2, an exemplary accessory office furniture component is shown as cabinet 24, though the brackets disclosed herein may also be used to mount other types of accessory office furniture components, such as work surfaces, shelves, etc, to one or more panels of a partition system. Cabinet 24 may be made from metal sheets and extruded members or from wood, for example, and includes front/rear panels 28, end panels 30, and bottom panel 32. Bottom portion 34 of cabinet 24 includes the bottom frame members 36 of front/rear panels 28 and bottom end frame members 38 of end panels 30. The bottom frame members 36 and 38 are connected to one another to form a rectangular bottom end frame 40 at the bottom portion 34 of cabinet 24. The bottom portion 34 of cabinet 24 further includes bottom panel 32 disposed interiorly of, and spaced above, bottom end frame 40. Bottom panel 32 is connected to bottom end frame 40 via welding, for example, or other securement means such as fasteners and the like. Alternatively, bottom panel 32 may be integrally formed with bottom end frame 40.

Figure 12:
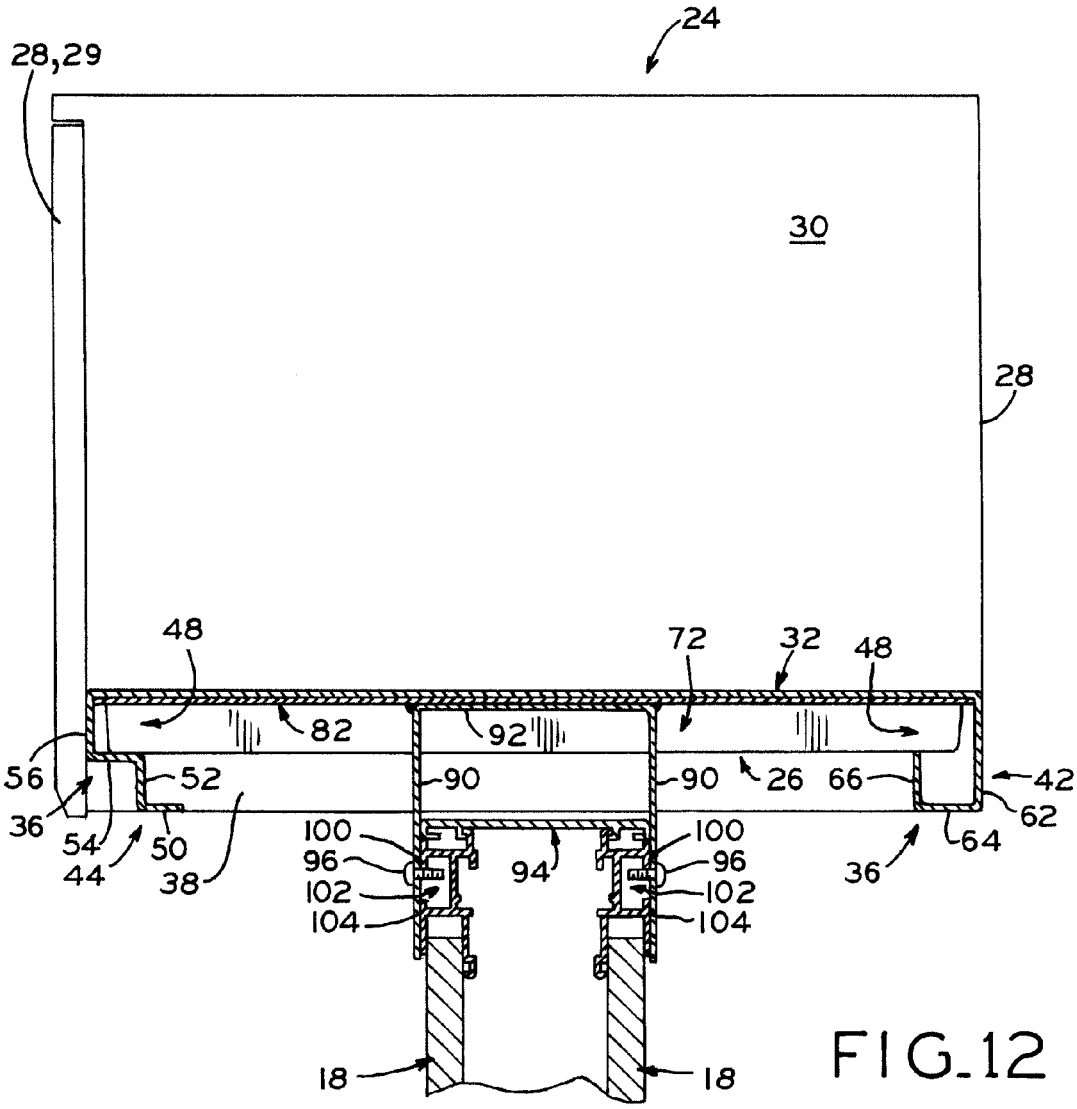
FIG. 12 is a cross-sectional view taken along line 12-12 of FIG. 11, showing the bracket of FIG. 11 together with an underlying panel to which the bracket is mounted, and a cabinet mounted to the bracket above the panel.

Referring to FIG. 12, bottom frame members 36 of side panels 28 include a pair of flanges 42 and 44 extending from and disposed below bottom panel 32. Together, the pair of flanges 42 and 44 and bottom panel 32 define a pair of gaps 48 for receipt of the horizontal member of a bracket as discussed below. Flange 42 of bottom end frame member 36 of rear panel 28, shown to the right in FIG. 12, has a U-shaped cross-section, and flange 44 of bottom end frame member 36 of front panel 28, shown to the left in FIG. 12, has a stepped cross-section.

One or both of front/rear panels 28 may be configured as doors. The front panel 28, shown on the left in FIG. 12, is configured as a door 29, with bottom end frame member 36 of this front panel 28 having stepped flange 44. Stepped flange 44 includes bottom horizontal wall 50, vertical web 52, and intermediate bottom wall 54. Vertical wall 56 extends upwardly from intermediate bottom wall 54 and abuts door 19 of front panel 28.

Bottom panel 32 connects vertical wall 56 of flange 44 to vertical wall 62 of flange 42 of bottom frame member 36 of rear panel 28, with flange 42 having a U-shaped cross-section. Flange 42 further includes bottom wall 64 extending towards the opposing side panel 28 from a bottom end of vertical wall 62 and a vertical web 66 extending upwardly towards bottom panel 32 from bottom wall 64 of flange 42.

The pair of gaps 48 are respectively defined between each of flanges 42 and 44 and bottom panel 32, and define a pair of respective clearances between flanges 42 and 44 and bottom panel 32, with the gaps 48 or clearances extending parallel to one another along a principal dimension of the cabinet, i.e., along a length, width, or depth dimension. With respect to stepped flange 44, intermediate bottom wall 54, vertical wall 56, and bottom panel 32 define a first gap 48. With respect to U-shaped flange 42, a top end of vertical web 66, vertical wall 62, and bottom panel 32 define a second gap 48.

Mounting of the Brackets to the Cabinets

Figure 4:
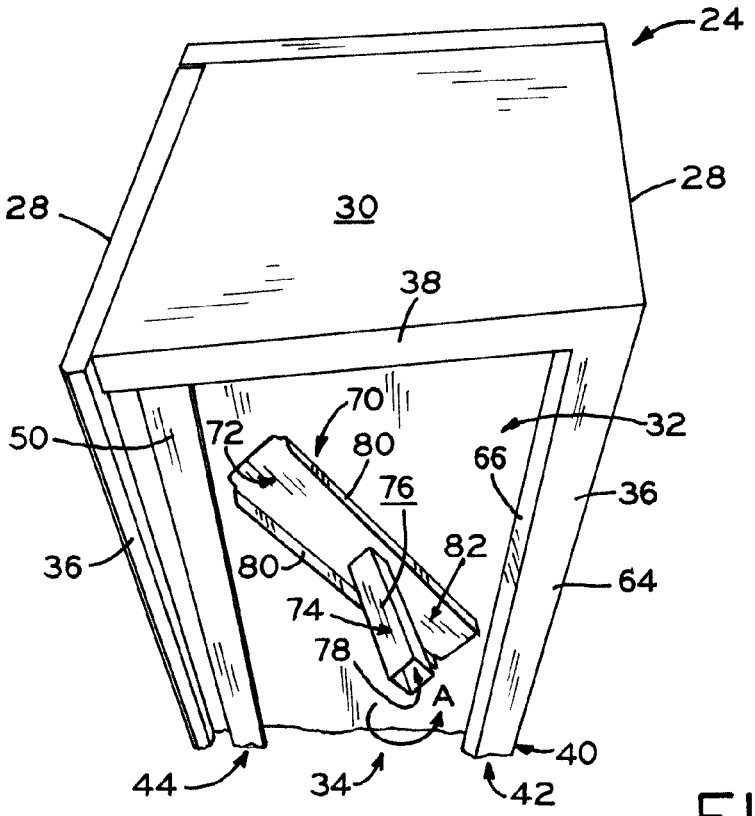
FIG. 4 is a bottom perspective view of the cabinet of FIG. 1 and the bracket of FIG. 3 in an initial insertion position with respect to the bottom frame of the cabinet.
Figure 5:
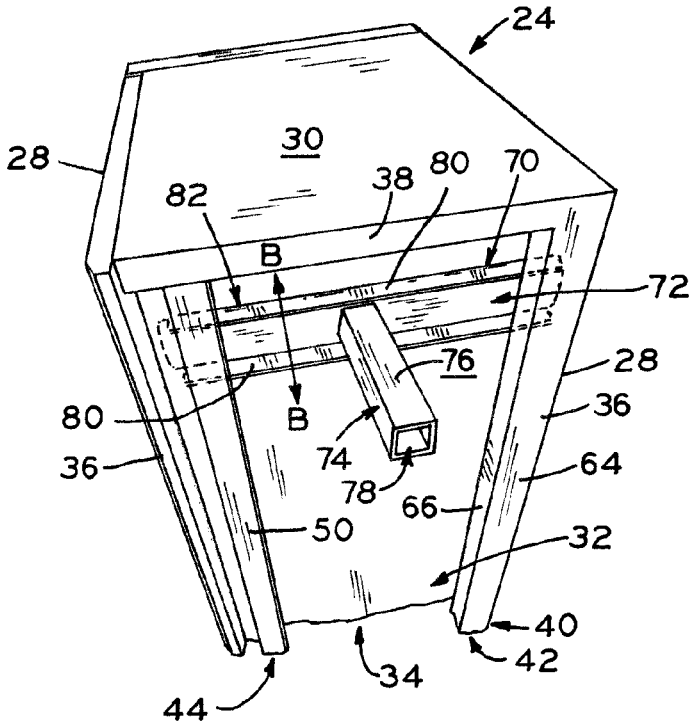
FIG. 5 is a bottom perspective view of the cabinet of FIG. 1, showing a continuation of FIG. 4 with the bracket rotated into a final supporting position with respect to the bottom frame of the cabinet.

Referring to FIGS. 4 and 5, the pair of gaps 48 receive the brackets of the present disclosure, such as bracket 70 of FIG.

3, the structure of which is described further below. Referring to FIG. 4, bracket 70 is mounted to bottom 34 of cabinet 24 by first positioning top wall 82 of bracket 70 against bottom panel 32 of cabinet 24 in an angular manner with respect to the longitudinal dimensional aspect of cabinet 24. For example, top wall 82 of horizontal member 72 of bracket 70 is placed adjacent bottom panel 32 of cabinet 24 with bracket 70 positioned at an angle with respect to (i.e., non-parallel with respect to) the pair of flanges 42 and 44 of bottom frame 40 such that the pair of downwardly extending flanges 80 of bracket 70 clear the pair of flanges 42 and 44 of the bottom frame, as shown in FIG. 4.

Bracket 70 is then rotated along the direction of arrow A of FIG. 4 until bracket 70 is positioned in a supporting position in which flanges 80 of bracket 70 are received within the opposing pair of gaps 48 (FIG. 12) of cabinet 24, and bracket 70 is disposed in an orientation perpendicular to the longitudinal dimensional aspect of cabinet 24. More particularly, top wall 82 of horizontal member 72 of bracket 70 is rotated along the direction of arrow A until the pair of downwardly extending flanges 80 of bracket 70 are dimensionally closely received within the pair of gaps 48 (FIG. 8) of cabinet 24 and horizontal member 72 of bracket 70 is disposed perpendicular to the pair of flanges 42 and 44 of bottom panel 32. In this manner, brackets 70 may be mounted to cabinet 24 without the use of tools or fasteners.

Each bracket 70 is adjustable along line B-B with respect to the longitudinal dimensional aspect of cabinet 24 by sliding bracket 70 along gaps 48. In this manner, as discussed further below, when brackets 70 are mounted to a partition system framework, cabinet 24 may be adjusted relative to brackets 70 to in turn adjust the position of cabinet 24 above the partition system framework along a horizontal direction indicated by line B-B.

First Bracket Embodiment

Figure 3:
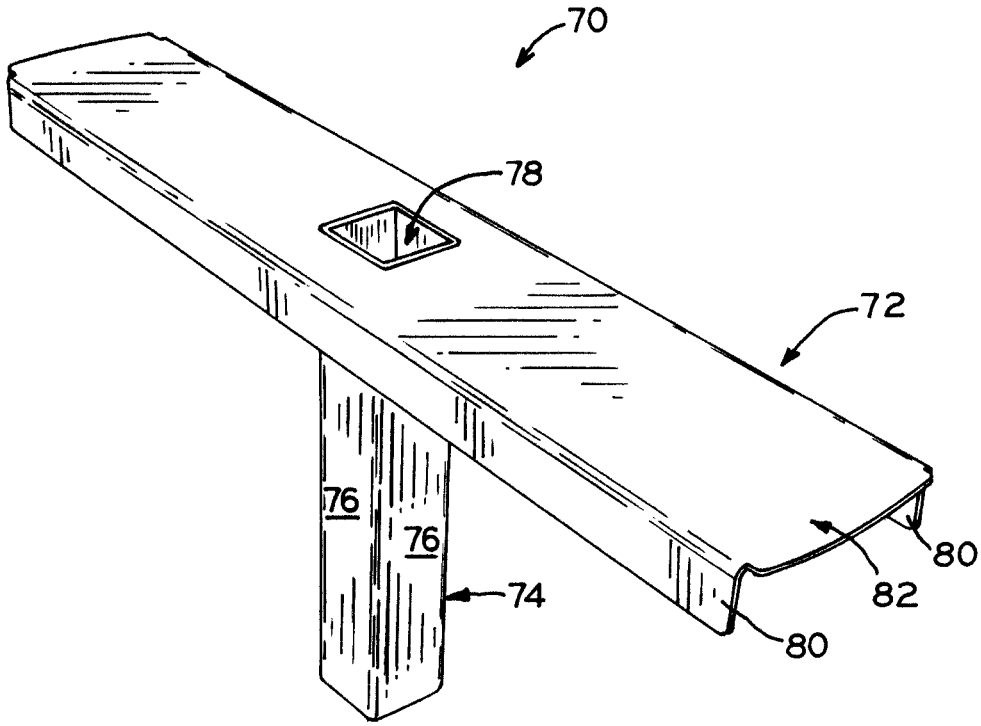
FIG. 3 is a perspective view of a bracket according to a first embodiment of the present invention.

Referring to FIG. 3, showing a first embodiment of a bracket according to the present disclosure, bracket 70 includes horizontal member 72 attached to a vertical member, such as vertical post 74, for example, in an orthogonal orientation. Vertical post 74 is centrally positioned below horizontal member 72 and distally and orthogonally extends from top wall 82 of horizontal member 72 past a pair of downwardly extending flanges 80 of horizontal member 72. While vertical post 74 is shown to have a cross-sectional shape that is square, other shapes are possible.

Vertical post 74 includes walls 76 defining an internal space 78 or alternatively, post 74 may be solid in cross-section. Horizontal member 72 includes a pair of opposing, downwardly extending flanges 80 that are connected by top wall 82 of horizontal member 72.

Figure 6:
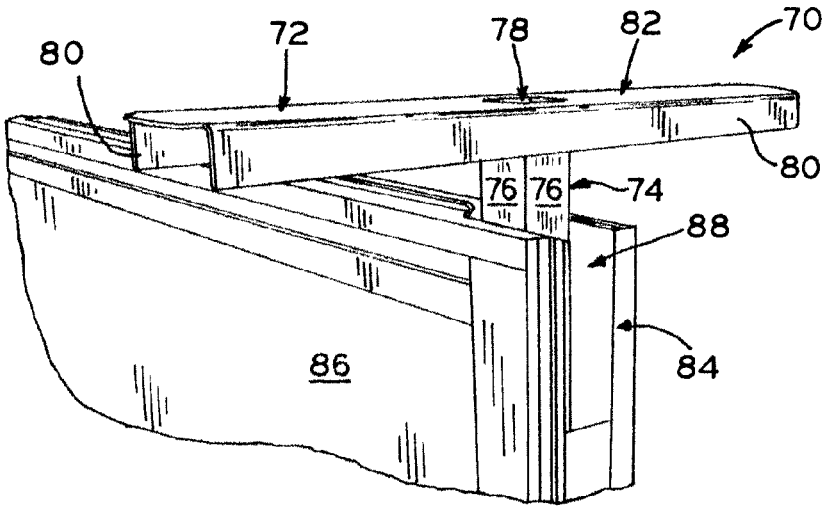
FIG. 6 is a perspective view of the bracket of FIG. 3 received within a vertical post of a panel frame.

Referring to FIG. 6, bracket 70 may be inserted into vertical panel post 84 disposed along an end of panel 86 of a panel system. Post 84 includes walls defining an aperture or opening 88 sized to receive vertical post 74 of bracket 70. Vertical post 74 may be received into vertical panel post 84 until ends of downwardly extending flanges 80 are disposed against a top end of the panel frame. Typically, another bracket 70 will be mounted within another vertical post 84 at the other end of the panel frame.

When cabinet 24 is supported atop one or more brackets 70, cabinet 24 may slide on top of top walls 82 of brackets 70 while brackets 70 remain positioned in vertical post 84 of panel 86, thereby permitting an extent of horizontal adjustment of the position of cabinet 24 with respect to posts 84 and, in turn, with respect to the underlying panel.

Another exemplary version of the first embodiment of a bracket according to the present disclosure is shown in FIGS. 7-10. Similar to bracket 70, bracket 110 includes horizontal member 72 attached to vertical post 112 in an orthogonal orientation. Vertical post 112 includes a different structure than post 74 of bracket 70 and horizontal member 72 further includes a pair of downwardly depending triangular flanges 120, as described below. While horizontal member 72 of bracket 110 attaches to cabinet 24 in the same manner described above in connection with bracket 70, bracket 110 attaches to a panel of the panel system in a different manner as described below.

Bracket 110 differs from bracket 70 in the structure of vertical post 112, which distally and orthogonally extends from top wall 82 past a pair of downwardly extending flanges 80 and includes a pair of half-cylindrical walls 114 that together define a generally cylindrical cross-sectional shape. Slot 116 is defined between the facing vertical ends of walls 114, and each wall 114 includes a curved bottom edge. The structure of vertical post 112, including slots 116, allows for deformation of post 112 when it is received into opening 132 of top cap 130 of the panel system, as further described below, as post 112 may be slightly larger than opening 132. Such deformation creates a tight fit between post 112 and opening 132.

Figure 10:
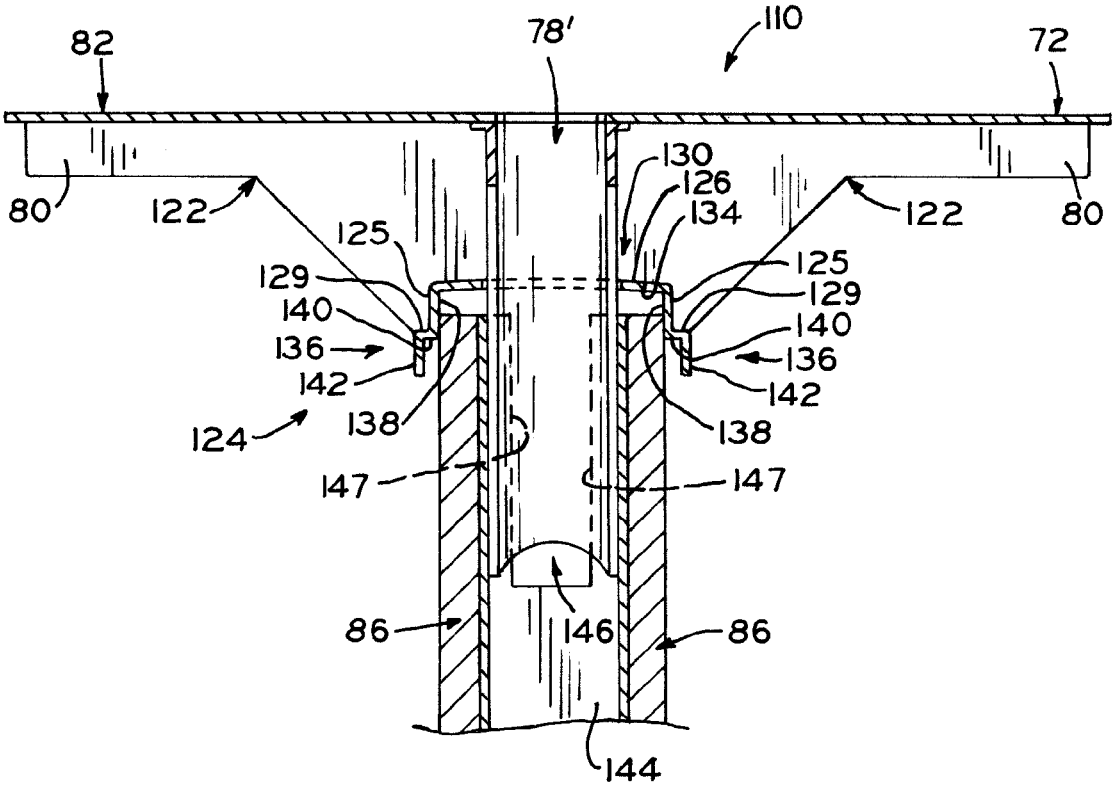
FIG. 10 is a cross-sectional view taken along line 10-10 of FIG. 9.

As shown in FIG. 10, post 112 may be received into a square tube of an underlying panel frame, such as square tube 144 (FIG. 10) positioned below top cap 130 and between the exterior walls of panel 86. Square tube 144 includes cutout 146 having guide walls 147 that may be received within slots 116 to aid in aligning post 112 and bracket 110 with tube 144 and to form an interference fit between post 112 and tube 144.

Referring back to FIG. 7, the shape of bracket 110 may be keyed to, or shaped complimentary to, the shape of top cap 130 of an underlying panel 86, preventing rotation of bracket 110 when seated on top cap 130. In particular, a pair of triangular flanges 120 extend downwardly from base 122 adjacent a respective one of the pair of downwardly extending flanges 80 of bracket 110 towards inverted top 124, which includes cutout 127. Each triangular flange 120 includes a pair of canted walls 123, with each cutout defined by a pair of vertical walls 125 and a horizontal wall 126.

Figure 8:
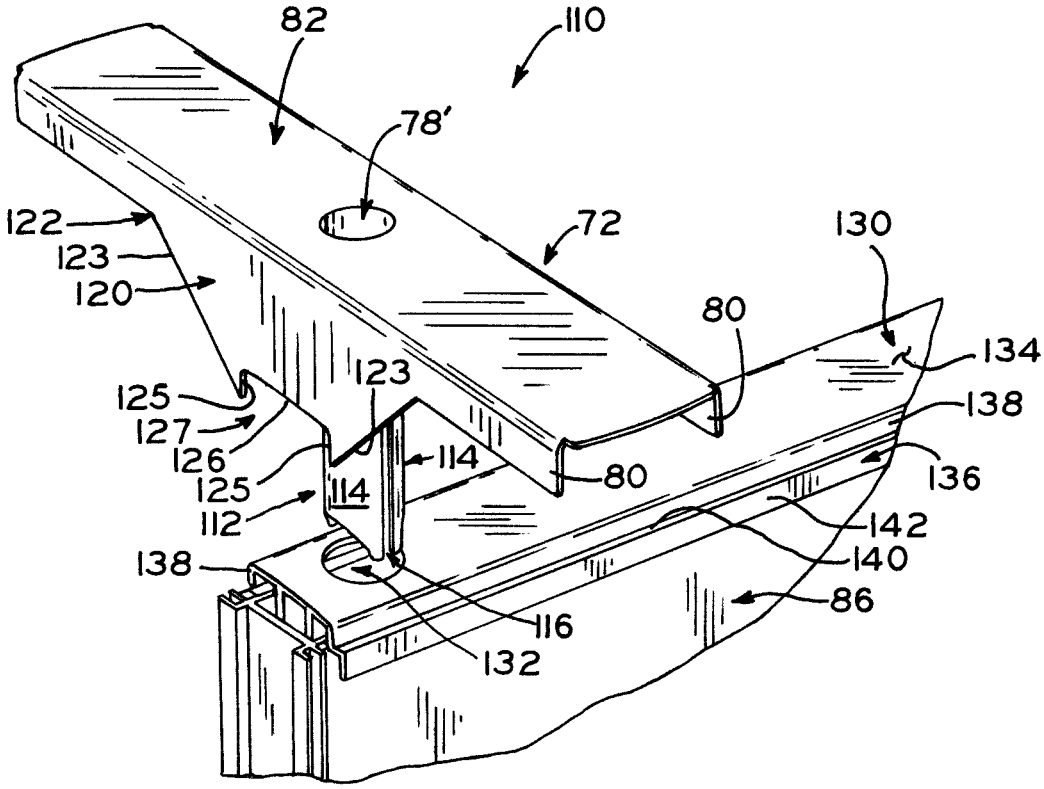
FIG. 8 is a perspective view of the bracket of FIG. 7, positioned above an underlying panel frame prior to receipt of the bracket within the panel frame.
Figure 9:
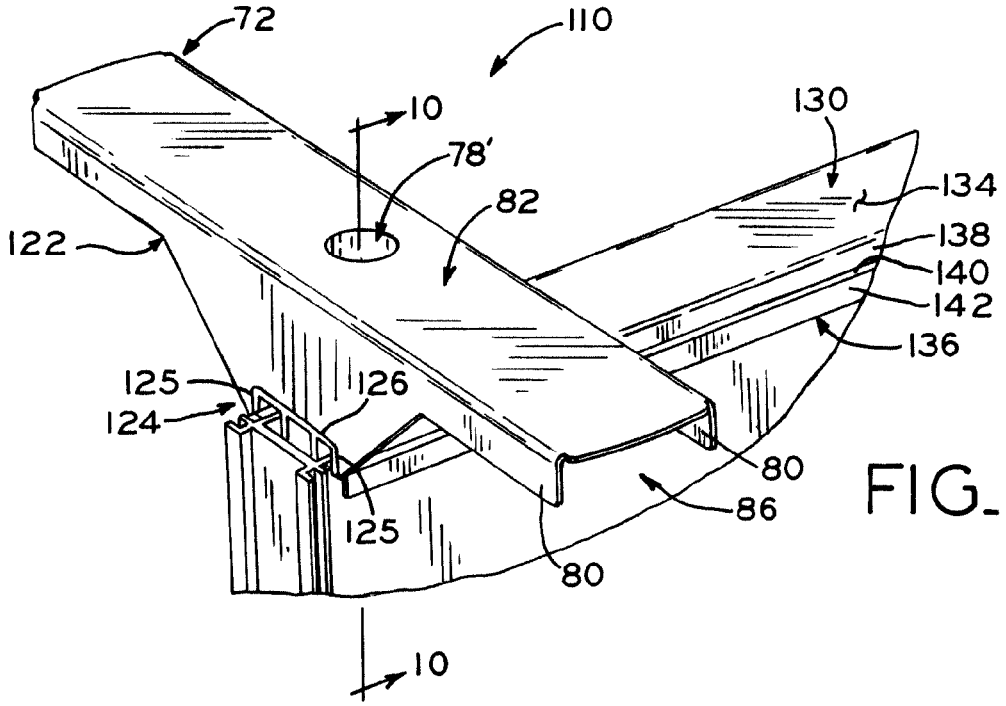
FIG. 9 is a perspective view of the bracket and panel frame of FIG. 7, showing the bracket received within a vertical post of a panel frame and seated on a top cap of the panel frame.

Referring to FIG. 8, top cap 130 includes top surface 134 disposed between and connecting a pair of stepped flanges 136. Each flange 136 includes an upper vertical wall 138, a horizontal wall 140, and a lower vertical wall 142. When post 112 is received within opening 132 of top cap 130, cutout 127 is fitted over, and indexed to, top surface 134 and stepped flanges 136 of top cap 130. In particular, as shown in FIGS. 9 and 10, vertical walls 125 of cutout 127 abut upper vertical walls 138 of stepped flanges 136 of top cap 130, and horizontal wall 126 of cutout 127 abuts top surface 134 of top cap 130. Further, as shown in FIG. 10, triangular flanges 120 of bracket 110 may also include horizontal walls 129 which abut horizontal walls 140 of stepped flanges 136 of top cap 130.

Figure 18:
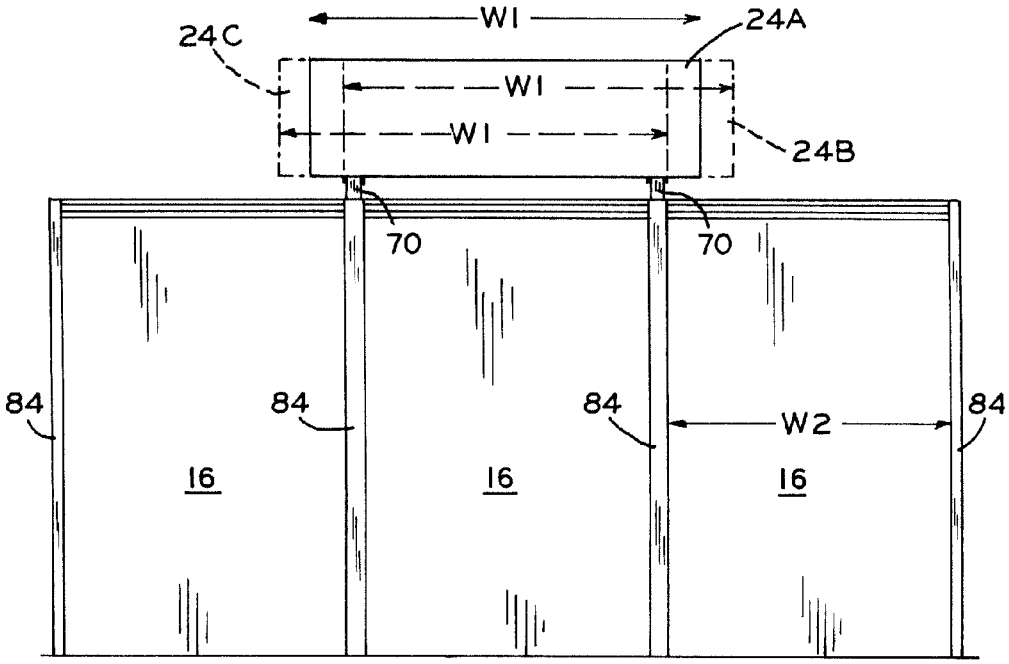
FIG. 18 is an elevational view of an office partition system, including a cabinet attached to vertical posts of an office partition system via a pair of brackets according to the first embodiment in an off-modular manner.

FIG. 18 shows a side elevational view of a partition system including the brackets 70 (or 110) of the first embodiment described above. A pair of spaced brackets 70 are used for mounting cabinet 24 to vertical panel posts 84 of underlying panels 16, each having width W2. As shown in FIG. 18, cabinet 24A has width W1 that is greater than width W2 of panel 16, though width W1 may alternatively be less than width W2. Further, the horizontal increment of adjustment between the bottom frame of cabinet 24 and brackets 70 described above permits the position of cabinet 24 to be horizontally adjusted from a first position, shown as position 24A in solid lines, to a second or third positions, shown as positions 24B and 24C in dashed lines, respectively.

Second Bracket Embodiment

Figure 11:
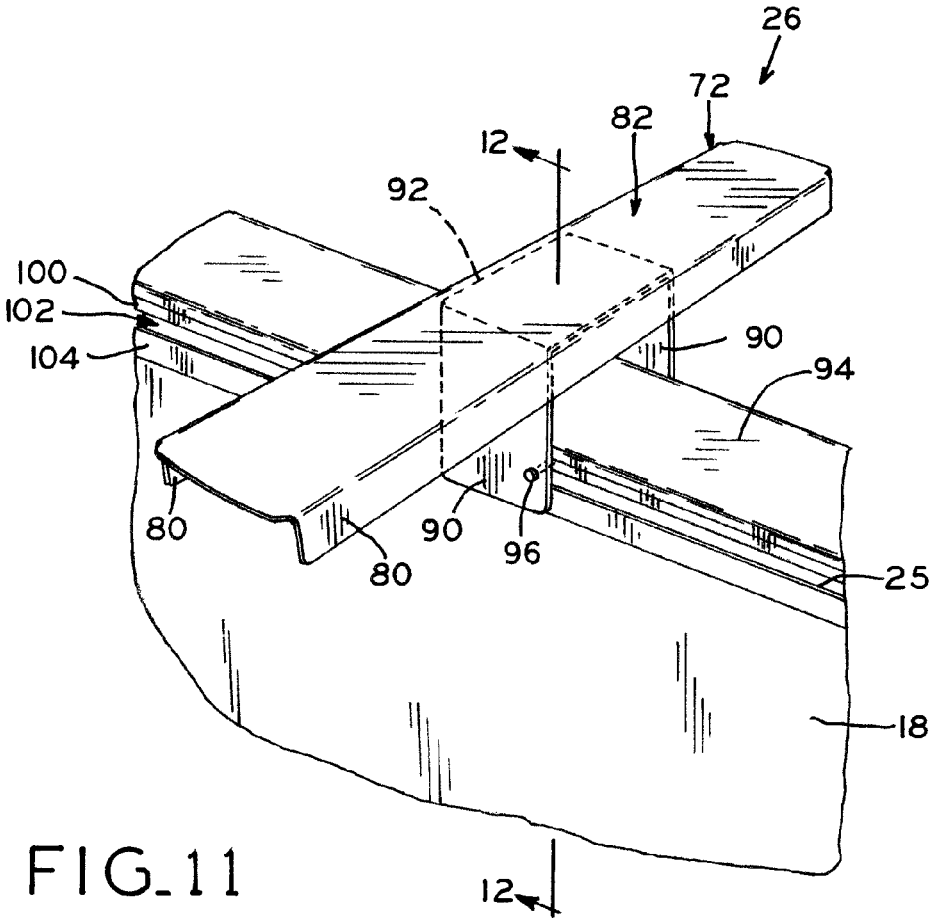
FIG. 11 is a perspective view of a bracket in accordance with another embodiment of the present invention, including a pair of vertical flanges for attachment to track member of a panel.
Figure 7:
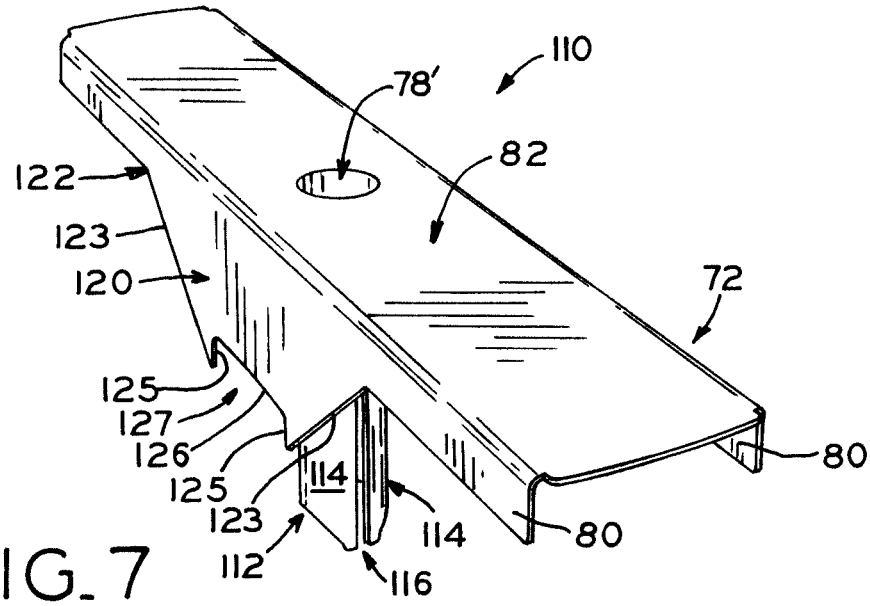
FIG. 7 is a perspective view of another bracket according to a second embodiment of the present invention.

A second exemplary embodiment of a bracket according to the present disclosure is shown in FIG. 11. Referring to FIG. 11, bracket 26 includes a horizontal member that is similar to the horizontal member of bracket 70 and is mounted within the bottom portion 34 of cabinet 24 in the same manner as described above in connection with bracket 70. Thus, similar reference numbers for the horizontal member and its components are used. However, in the second exemplary embodiment, bracket 26 includes a pair of vertical flanges 90 connected by a top flange, such as top wall 92, that abuts against top wall 82 of horizontal member 72.

FIG. 12 shows a cross-sectional view taken along a vertical axis of bracket 26 in which cabinet 24 is seated atop an underlying panel 18 (FIG. 1). Panel 18 may include track members to receive modular accessory items, for example, such as cabinets or shelving units. Other possible designs and uses for such track members are within the scope of this disclosure, such as those described within U.S. Pat. No. 5,309,686 entitled "Work Space Partition System", issued May 10, 1994, and U.S. Pat. No. 7,540,115 entitled "Partition System", issued Jun. 2, 2009, each assigned to the assignee of the present invention, the entire disclosures of which are expressly incorporated by reference herein.

Figure 13A:
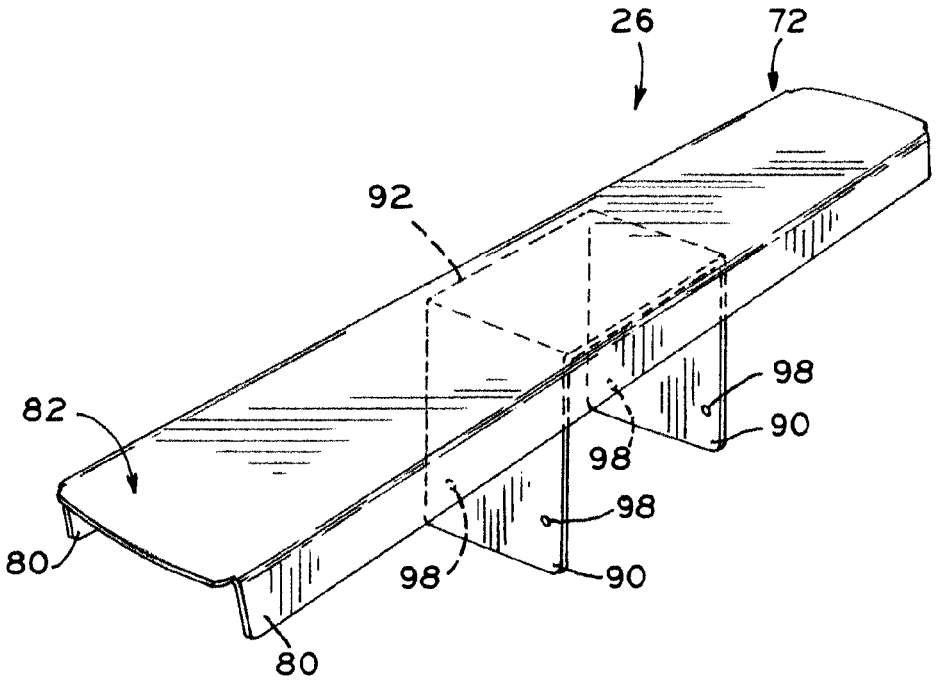
FIGS. 13A and 13B are perspective views of first and second versions of the bracket of FIG. 11.
Figure 13B:
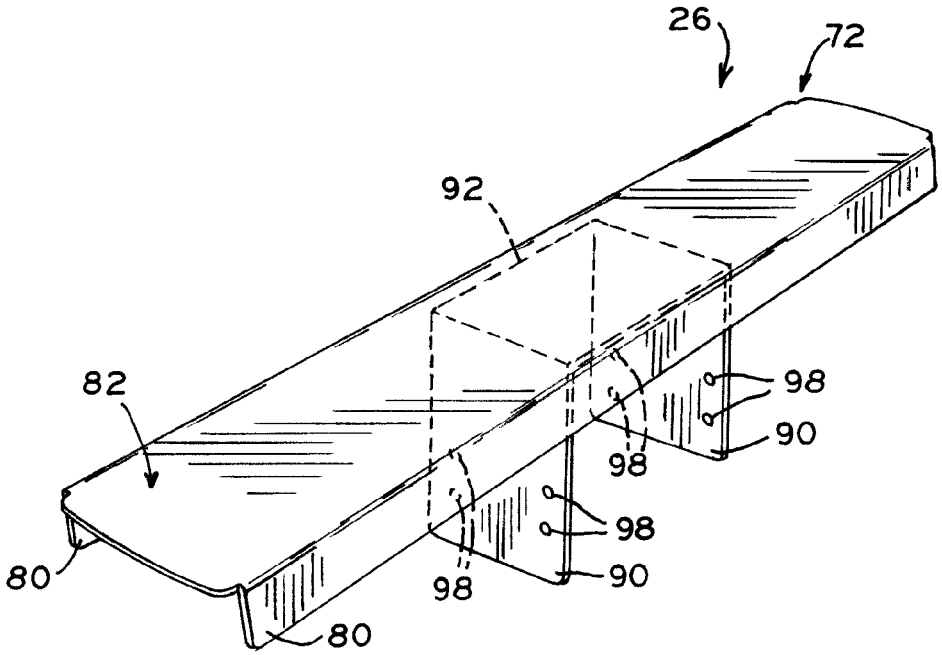

Referring to FIG. 12, bottom frame members 38 of end panels 30 of cabinet 24 may be supported or rested on an upper edge 94 of panel 18, which may be defined by a top cap. Track members 25 are disposed on opposing faces of panel 18 proximate to, and below, top edge 94. Vertical flanges 90 of bracket 26 are positioned along track members 25. Stabilizing screws 96 may be positioned through holes 98, as shown in FIG. 13A, and against a bottom end of upper wall 100 (FIG. 12) of track member 25 which along with bottom wall 104 of wall track 25, defines channel 102 of track member 25. As shown in FIG. 13A, a first set of screw holes 98 is provided in each of vertical flanges 90. An additional second set of holes may be provided within vertical flanges 90 above or below the first set of holes, as shown in FIG. 13B for example, to allow the use of multiple sets of screws 96, such that screws 96 may contact or engage both the upper wall 100 and the bottom wall 104 of the track members 25 to further stabilize bracket 26.

Figure 14:
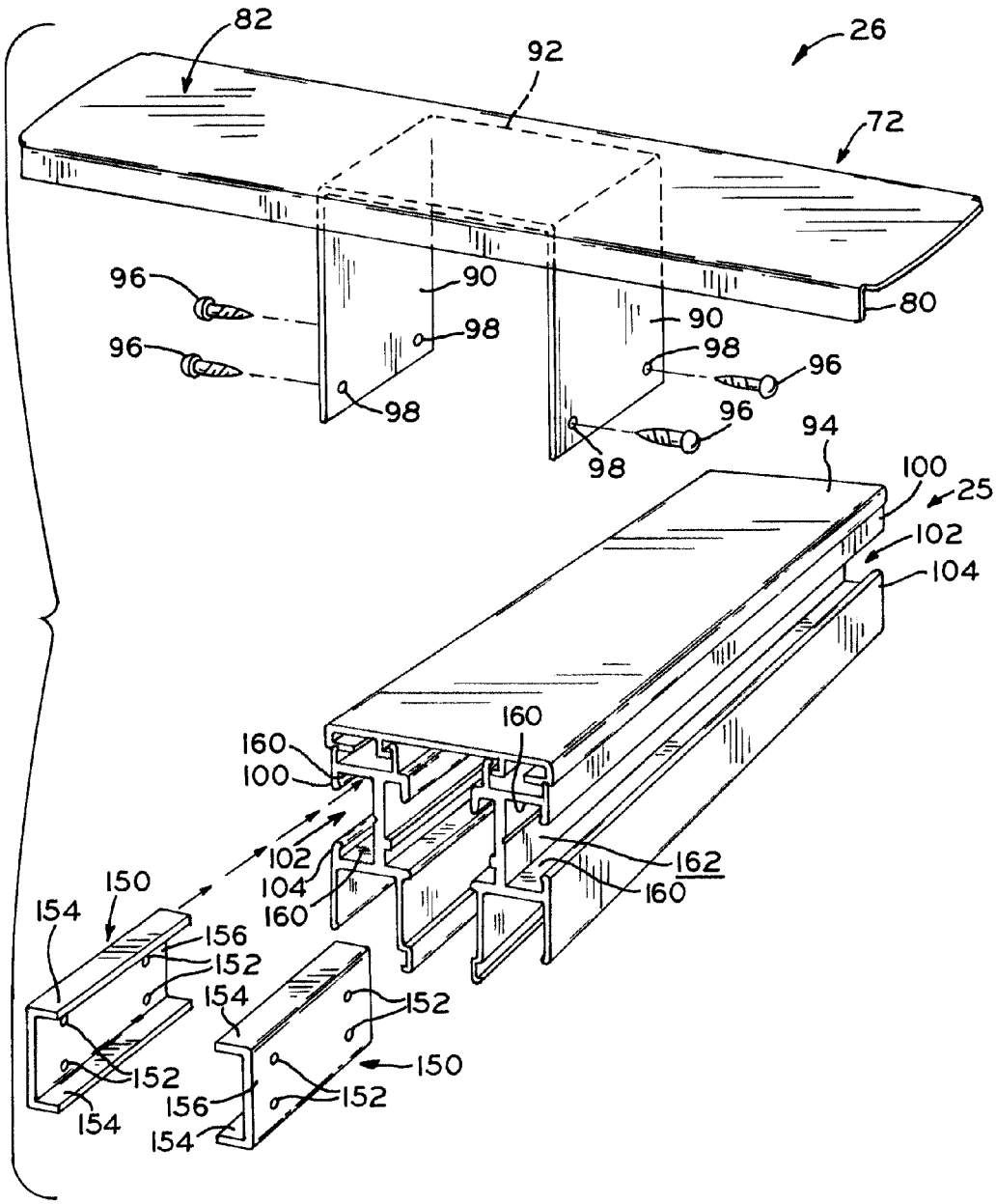
FIG. 14 is an exploded perspective view of the bracket of FIG. 11, a pair of track members to which the bracket is connected, and a pair of additional U-shaped anchor members for receipt in the track members and to which the bracket is mounted.
Figure 15:
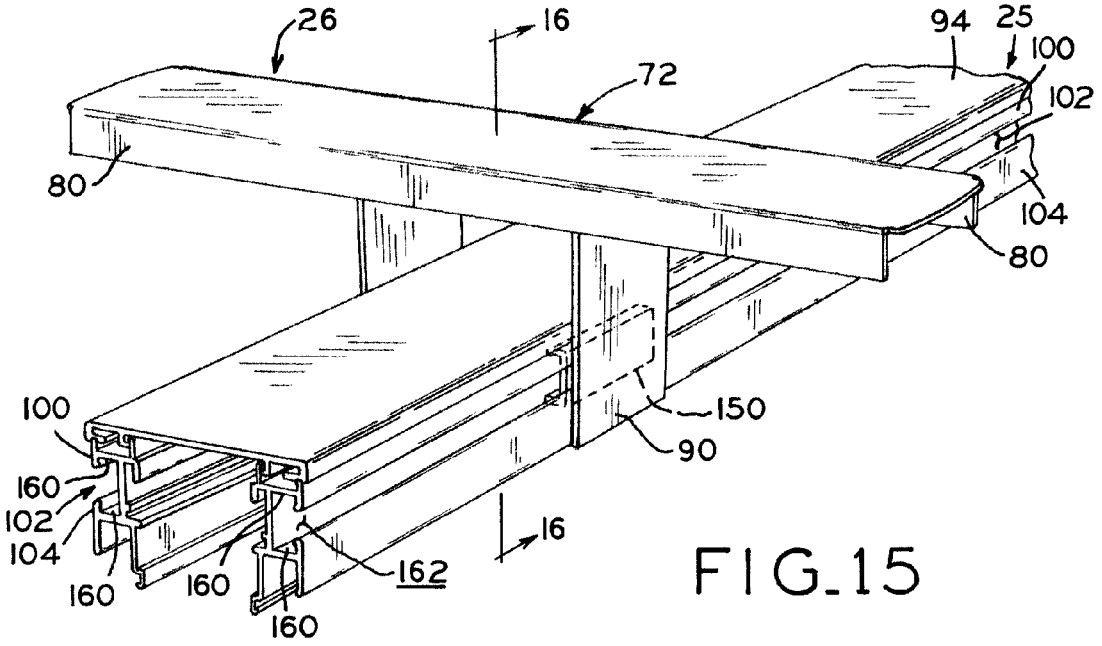
FIG. 15 is an assembled view of the bracket, track members, and anchor members of FIG. 14.
Figure 16:
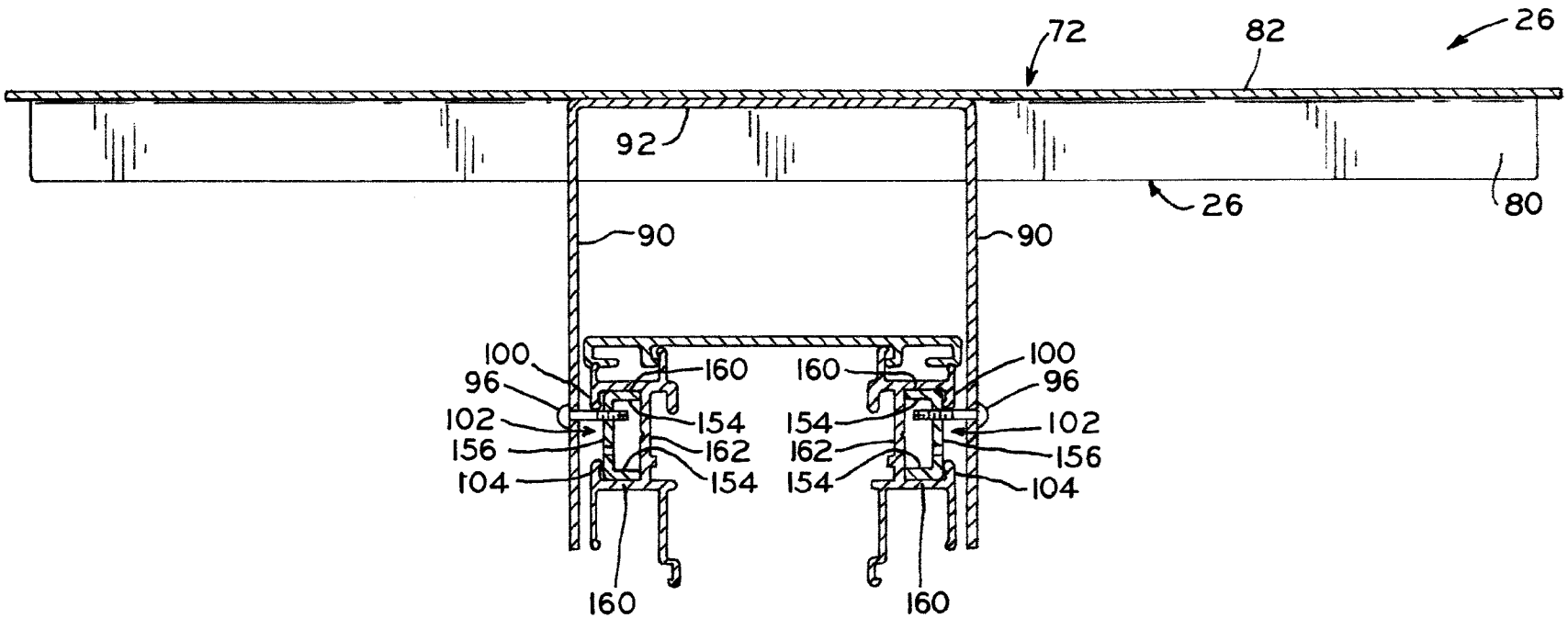
FIG. 16 is a cross-sectional view taken along line 16-16 of FIG. 15.

Alternatively, in another version of the second embodiment of the present disclosure, bracket 26 may be attached to track member 25 of a panel as described above with the additional use of a pair of U-shaped anchor members 150, as shown in FIGS. 14-16. Each U-shaped anchor member 150 includes screw holes 152, a pair of horizontal walls 154, and a vertical wall 156 disposed between horizontal walls 154. When each U-shaped anchor members 150 is received within the channel 102 of track member 25, as shown in FIGS. 15 and 16, the pair of horizontal walls 154 are disposed against a pair of upper and lower horizontal walls 160 of track member 25, with walls 160 connected by an intermediate vertical wall 162 of track member 25. Vertical wall 156 of each U-shaped anchor member 150 has an upper portion disposed against upper wall 100 of track member 25 and a lower portion disposed against bottom wall 104 of track 25. Screws 96, as shown in FIG. 16, may be inserted through a selected pair of screw holes 152 of each U-shaped bracket 150 to mount bracket flanges 90 to U-shaped brackets 150 with screws 96 optionally additionally secured and disposed against a bottom edge of upper wall 100 of track member 25.

Figure 17:
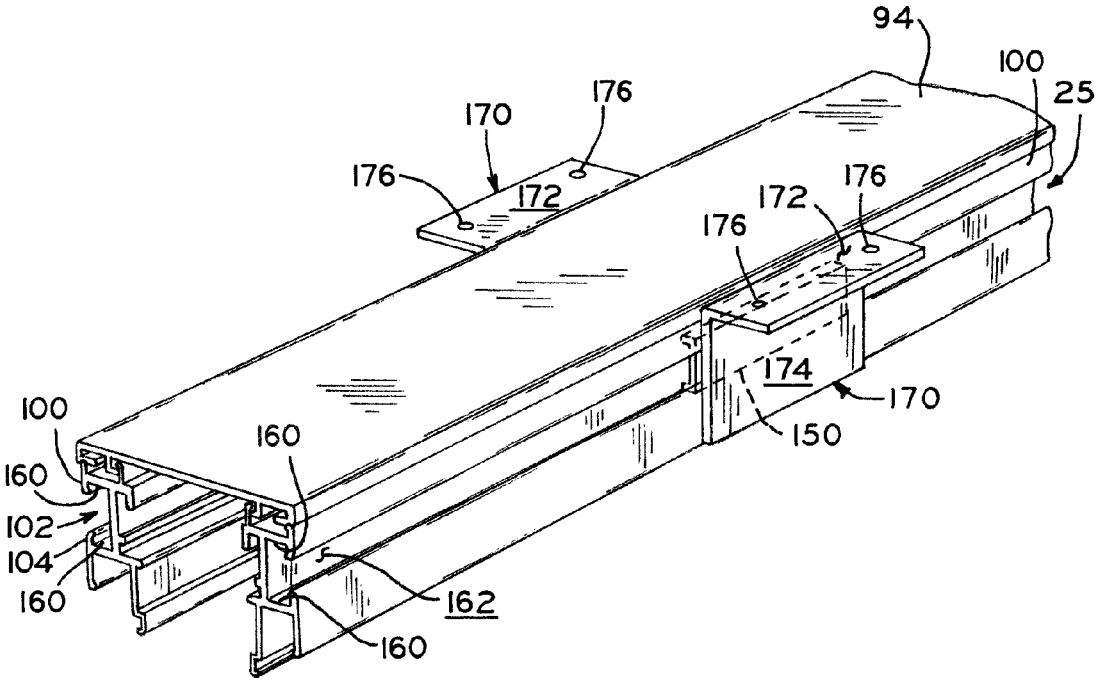
FIG. 17 is an assembled view of a bracket assembly according to a further embodiment, mounted to a pair of track members using anchor members.

FIG. 17 shows yet another version of the second embodiment of the present disclosure incorporating U-shaped anchor members 150 in track members 25 that attach to an alternative bracket, shown as bracket 170 including top horizontal wall 172 with a top planar surface, and side vertical wall 174. Bracket 170 also includes holes 176 for receipt of fasteners, such as screws, to connect the top planar surface of top horizontal wall 172 to a flat bottom surface of an article of furniture, such as a cabinet having a planar bottom surface.

Figure 19:
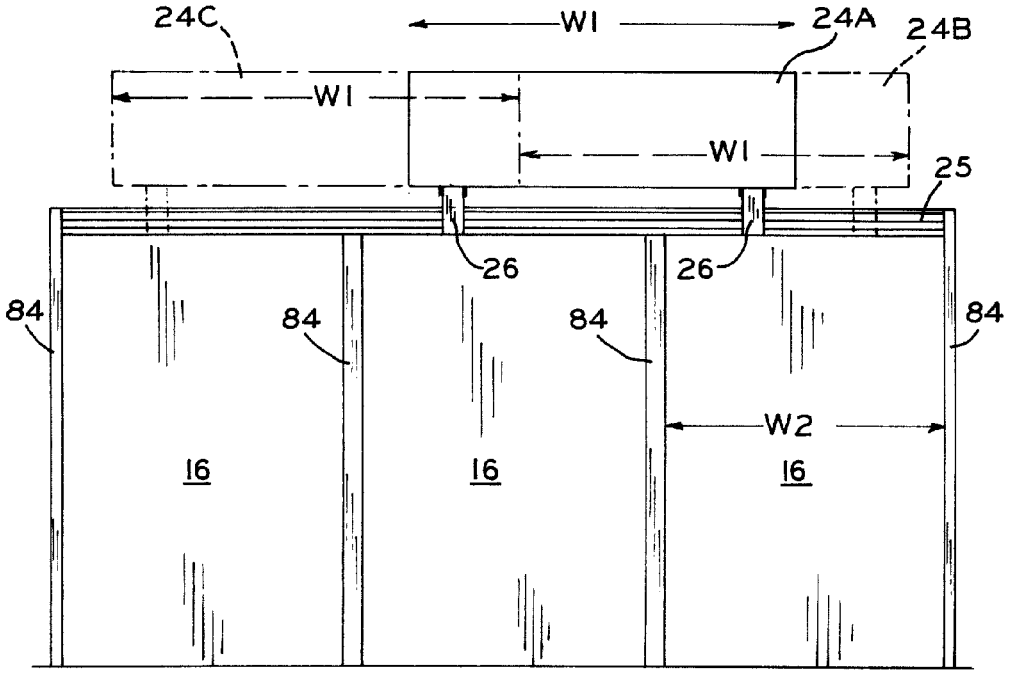
FIG. 19 is an elevational view of an office partition system, including a cabinet attached to track members of the partition system panels via a pair of brackets according to the second embodiment in an off-modular manner.

FIG. 19 shows a side view of a partition system including the brackets of the second embodiment described above. Cabinet 24 is mounted to a pair of spaced brackets 26, which in turn are mounted to track members 25 of the panels as described above, each panel having a width W2. Cabinet 24 has width W1 that is greater than width W2 of panels 16, though width W1 may alternatively be less than width W2. Cabinet 24 is positionable in a first position 24A shown in solid lines, though the location of the brackets 26, and in turn the location of cabinet 24, is infinitely horizontally adjustable along the track members 25, as represented by other exemplary cabinet positions 24B and 24C shown in dashed lines. In this manner, the position of cabinet 24 is independent of the width and/or positions of the underlying panels 16.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An office partition system, comprising:

a framework having an upper edge and including a pair of track members disposed on respective opposite sides of said framework, said track members disposed proximate said upper edge, each said track member comprising a horizontally-oriented channel extending continuously along said track member and opening outwardly with respect to said framework, each said horizontally-oriented channel comprising:

a vertical intermediate wall;

a horizontal upper wall projecting from said vertical intermediate wall and terminating in an upper front wall that extends vertically downward from said horizontal upper wall; and a horizontal lower wall projecting from said vertical intermediate wall substantially parallel to said horizontal upper wall and terminating in a lower front wall that extends vertically upward from said horizontal lower wall;

a bracket respectively adjustably received within each of said track members; and a cabinet mounted to each said bracket and disposed above said upper edge of said framework.

2. The partition system of claim 1, wherein said cabinet is dimensioned to extend outwardly beyond each of said opposite sides of said framework such that said cabinet straddles said framework.

3. The partition system of claim 1, wherein said track members are elongate and continuous, said brackets adjustably repositionable along said track members.

4. The partition system of claim 1, further comprising a top cap attached to an upper edge of said framework.

5. The partition system of claim 4, wherein said cabinet includes a bottom frame having a horizontal member, said horizontal member mounted to said brackets, said horizontal member disposed above said top cap.

6. The partition system of claim 4, wherein each said bracket comprises a horizontal upper flange, said cabinet mounted to said horizontal upper flanges, said cabinet including a lower surface disposed in spaced relation above said upper surface of said top cap.

7. The partition system of claim 1, wherein each said bracket includes at least one hole for receipt of a fastener.

* * * * *